US005410930A

United States Patent [19]

DeLuca et al.

[11] Patent Number: 5,410,930

[45] Date of Patent: May 2, 1995

[54] LOW OPERATING FORCE STOP MECHANISM AND DISPENSING METHOD FOR ROLLED WEB DISPENSERS

[75] Inventors: Raymond F. DeLuca, Stampford, Conn.; John S. Forman, Marietta, Ga.

[73] Assignee: Georgia Pacific Corporation, Atlanta, Ga.

[21] Appl. No.: 65,358

[22] Filed: May 24, 1993

Related U.S. Application Data

[63] Continuation of Ser. No. 742,476, Aug. 5, 1991, abandoned.

[51] Int. Cl.[6] ..... A47K 10/36; B65H 35/08

[52] U.S. Cl. ..... 83/335; 83/337; 83/649; 83/660; 83/678

[58] Field of Search ..... 83/334, 335, 337, 339, 83/346, 660, 649, 678; 225/96, 106; 226/121, 131

[56] References Cited

U.S. PATENT DOCUMENTS 3,739,965 6/1973 Jespersen et al. ..... 225/96

*Primary Examiner*—Hien H. Phan

*Attorney, Agent, or Firm*—Banner, Birch, McKie & Beckett

[57] ABSTRACT

A stop mechanism for a feed roller associated with a cutter in a dispenser for flexible rolled web material has a stop lever which provides a substantial mechanical advantage. The increased mechanical advantage permits the vacuum cups of a vacuum cup timer to be effortlessly and reliably set. The stop lever has a long actuating arm which pivots about a pivot point. The long actuating arm creates a substantial mechanical advantage for setting the vacuum cups in vacuum-gripping engagement. The mechanism advantage greatly enhances the low pull force requirement and smooth operation of the dispenser.

11 Claims, 6 Drawing Sheets

LOW OPERATING FORCE STOP MECHANISM AND DISPENSING METHOD FOR ROLLED WEB DISPENSERS

This application is a continuation application of application Ser. No. 07/742,476, filed Aug. 5, 1991, now abandoned.

BACKGROUND OF THE INVENTION

This invention relates to a one-revolution stop mechanism for a dispenser and a dispensing method for rolled web material of the flexible sheet type such as paper toweling. The stop mechanism has a low operating force and is associated with the feed roller in the dispenser to allow the feed roller to undergo one revolution and then be stopped in dispensing an individual sheet of the rolled weld material.

Dispensers for rolled flexible sheet material, such as paper toweling, are well-known in the art and many of these dispensers include mechanisms for perforating or severing a web of material to divide the web into individual sheets. Towel dispensers have also been developed with various mechanisms or techniques to provide a waste-restricting system, namely, the dispenser permits only a single individual sheet to be dispensed to the intending user at one time with a delay being provided before the user can gain access to a second individual sheet.

For sanitary reasons, towel dispensers in public washrooms should preferably be operable by merely pulling down on an exposed portion of the towel weld with no need to touch parts of the dispenser such as cranks, buttons or levers commonly present in many prior art types of towel dispensers, these actuators serving to activate the towel dispenser in supplying the length of towel web or individual toweling sheets.

At the same time, for the sake of economy, the dispenser should eliminate unnecessary waste of paper toweling while still not unduly restricting use of the toweling to the intending user. Certain dispensers now on the market accomplish these objectives by such devices as spring-operated one-revolution stop feeding mechanisms and vacuum cup timers. Spring-operated devices have the disadvantage that in being cocked while the towel is being withdrawn from the dispenser, a substantial drag is placed on the web of paper toweling, often resulting in it being prematurely torn where it is held by the wet fingers of the intending user. Prior art vacuum cup timers provide the needed time delay between withdrawal of individual towel sheets to thus reduce waste but have the disadvantage that the desired preset time intervals cannot be reliably maintained especially at very short time interval settings.

In addition, in paper towel dispensers where the towel web is severed or perforated internally, a device must be provided to prevent the premature separating of individual towels from the following web as it uncoils from the supply roll of toweling. Strong, thus, harsh, paper toweling is therefore required.

FIG. 1 represents one example of a towel dispenser known in the prior art. The dispenser 30 has a cabinet 31 adapted to be mounted at a convenient location for intending users of the paper toweling supplied from the rolled web material carried within the cabinet 31. A portion of the cabinet 31 is broken away to display a portion of the one-revolution stop mechanism and other components mounted within the cabinet 31.

A roll 1 of flexible web material is mounted on a yoke 33, the yoke being pivoted at 34 to the backplate of the dispenser cabinet 31. Yoke 33 has a pair of yoke arms with cups 32 rotatably mounted at the outer ends of the yoke arms, these cups being inserted at each core end into the central tubular core of the towel roll 1. With this rather conventional mounting for roll 1, due to gravity the roll rests against the backplate of cabinet 31 to provide a slight braking action and prevent overspinning of the roll when the paper towel web is being removed.

The web W withdrawn from roll 1 is threaded counterclockwise around a pinchroller 3. The web then passes clockwise around the rearside of a feed roller 4 to pass counterclockwise over an exit pinchroller 24. Pinchrollers 3 and 24 are pressed against the feed roller 4 by springs (not shown) with all rollers being supported by appropriate bearings (not shown) in the sideplates of the dispenser cabinet 31. The web W then exits through opening 26 in cabinet 31 to be accessible to intending users of the paper toweling material coming from roll 1. Preferably a tab length T of the toweling web W of about 3 inches will extend outside the dispenser beyond opening 26 to be available for grasping by the intending users of the web material. This preferred length T of web material is automatically fed from the dispenser 30 in conjunction with the operation of a one-revolution stop mechanism.

The feed roller 4 has an internal knife 40 which is mounted laterally offset from the rotational axis of feed roller 4. Knife 40 is supported within the feed roller to project through an opening (not shown) in the feed roller periphery to essentially sever the web material when it passes over the feed roller surface as the feed roller 4 makes a single revolution. The web material is thus perforated to leave only, for example, three uncut $\frac{1}{4}$ inch long tabs connecting successive sheets in the web. This transverse perforating of the web material in cabinet 31 defines individual sheets which are of a length equal to the feed roller circumference so that the web W is formed with a row of perforations between one sheet and the next succeeding sheet.

Details of the mounting and operating mechanism for the cutting knife 40 are not shown but the construction may be of the sliding cutter construction disclosed in U.S. Pat. No. 4,712,461.

Feed roller 4 is rotatably mounted on shaft 32 which extends through an appropriate bearing which is carried by the sidewall of cabinet 31. Shaft 32 extends outwardly beyond the bearing and has a feed wheel 36 fixedly secured to R outer end. The feed wheel 36 has a control tab 38 which cooperates with a stop lever 41 to constitute the active components of the stop mechanism as described in allowed and commonly assigned application Ser. No. 838,799 (now U.S. Pat. No. 5,275,446).

U.S. Pat. No. Re 28,911 discloses the use of a conventional vacuum cup timer to provide a time delay between withdrawal of individual towel sheets. The operation of this type of timer will be explained with reference to FIGS. 2 and 3 which are taken from FIG. 10 of the U.S. Pat. No. Re. 28,911.

FIG. 2 is a side elevational view of the one-revolution stop mechanism in an unlatched position as used in the dispenser disclosed in the U.S. Pat. No. Re. 28,911. The mechanism includes a feed wheel 240 which is drive by the towel web being pulled from the dispenser. The mechanism also includes a stop lever 230 which pivots about pivot pin 232. Stop lever 230 has a cam follower 234 and a stop lug 236 which engage camming pin 238 formed on feed wheel 240.

As shown in FIG. 2, cam follower 234 is positional in the rotational path of camming pin 238. The rotation of feed wheel 240 causes camming pin 238 to engage the underside of cam follower 234, raising cam follower 234 upwardly. Stop lever 230, thus, pivots in a clockwise direction about pivot pin 232. As stop lever 230 pivots, vacuum cup 242 is drawn into vacuum-gripping relationship with vacuum cup 244. As feed wheel 240 continues to rotate, camming pin 238 passes under and out of engagement with cam follower 234 to arrive at the position shown in FIG. 3. In this position, vacuum cups 242 and 244 are in full vacuum-gripping relationship and stop lug 236 is in engagement with camming pin 238. The vacuum-gripping force of vacuum cups 242 and 244 maintain stop lever 230 in the position shown in FIG. 3, thus preventing further rotation of feed wheel 240 due to the engagement of camming pin 238 with stop lug 236. The arrested motion of feed wheel 240 results in increased pulling force on the towel which permits an individual sheet of paper toweling to be torn from the web along preformed perforations.

Vacuum cups 242 and 244 remain in vacuum-gripping relationship for a predetermined period of time which is regulated by needle valve 254. Needle valve 254 allows a controlled flow of ambient air into the vacuum environment between vacuum cups 242 and 244 in order to regulate the period of time during which the cups remain in vacuum-gripping relationship. After the vacuum-gripping relationship is destroyed by the entry of ambient air between vacuum cups 242 and 244, stop lever 230 is returned to its unlatched position as shown in FIG. 2 by spring 256 for the start of another cycle.

Though vacuum cup timers perform their intended function, they suffer from a number of disadvantages. As mentioned above, the desired preset time delay interval cannot be reliably maintained, especially at very short time interval settings. Another such disadvantage is that a relatively large amount of compression force is required in order to engage the vacuum cups in a vacuum-gripping relationship. Creation of such a large force also creates a corresponding drag on the towel web, often resulting in premature tearing of the towel. This particular disadvantage is addressed in the U.S. Pat. No. Re. 28,911 patent by making one cup of a relatively hard resilient material and the other of a relatively soft resilient material. The use of a soft resilient material also provides a better cushion for absorption of forces generated by the abrupt arresting of feed wheel movement, thus minimizing wear of the stop mechanism components.

Though the use of resilient material for one of the vacuum cups presents a solution to the high compression force problem, other problems are created. For example, manufacturing cost are increased due to the need to fabricate cups from two different materials. There are obvious economies to be realized if both cups are of the same design and material. In addition, reducing the hardness of the vacuum cups also reduces the vacuum-gripping force between the cups.

SUMMARY OF THE INVENTION

It is the overall objective of the present invention to provide a towel dispenser which can be operated at a low user pull force.

It is a specific objective of the present invention to provide a one-revolution stop mechanism for a dispenser which requires substantially less force to cycle than such mechanisms known in the prior art.

It is a further specific objective of the present invention to provide a one-revolution stop mechanism which permits a towel dispenser to be used with a wide variety of soft-ply paper towels.

It is another specific objective of the present invention to provide a one-stop revolution mechanism which is efficient and reliable in operation.

It is a still further objective of the present invention to provide a towel dispenser wherein individual towels reliably separate from the web outside of the dispenser.

The rolled web dispenser of this invention basically overcomes the above-mentioned disadvantages of prior art dispensers by eliminating the use of feed-out springs altogether and provides a great improvement over the conventional use of vacuum cup timers. The present invention provides a fully reliable momentary stop and time delay which makes possible the use of very soft and weak paper toweling, with the dispenser being operated solely by pulling on the paper web of toweling while still providing the desired waste restricting system.

The dispenser for rolled web flexible material of this invention overcomes the disadvantages discussed above with reference to prior art proposals by providing a stop mechanism for the feed roller which has a substantial advantage over conventional stop lever designs. Thus a relatively small force by the user in pulling a towel from the dispenser is translated in a correspondingly larger force for setting the vacuum cups into vacuum-gripping engagement. As a result, operation of the dispenser is made much easier. The stop lever in accordance with Applicant's invention has a long actuating arm which pivots about a pivot point. The long actuating arm creates a substantial mechanical advantage for setting the vacuum cups in vacuum-gripping engagement. The mechanism advantage afforded by the stop lever of Applicant's invention greatly enhances the low pull force requirement and smooth operation of the dispenser. The pneumatic and elastic characteristics of the stop mechanism which incorporates Applicant's stop lever serves as an efficient way of absorbing the energy generated when the dispensing mechanism is cycled and abruptly stopped.

In addition, the problem with prior art dispensers having conventional spring biased exit pinch rollers is overcome by Applicants dispenser. In Applicant's dispenser, the exit pinch roller is allowed to float in a slot. The slot is in angular relationship with the feed roller such that the web is drawn into biting relationship with the pinch roller when the web is pulled. This arrangement assures that the towel will separate outside the dispenser when pulled.

The above objectives and features of the invention will become apparent upon consideration of the detailed description of a preferred embodiment of the invention in connection with the accompanying drawings.

DESCRIPTION OF THE PREFERRED EMBODIMENTS

Figure 1:
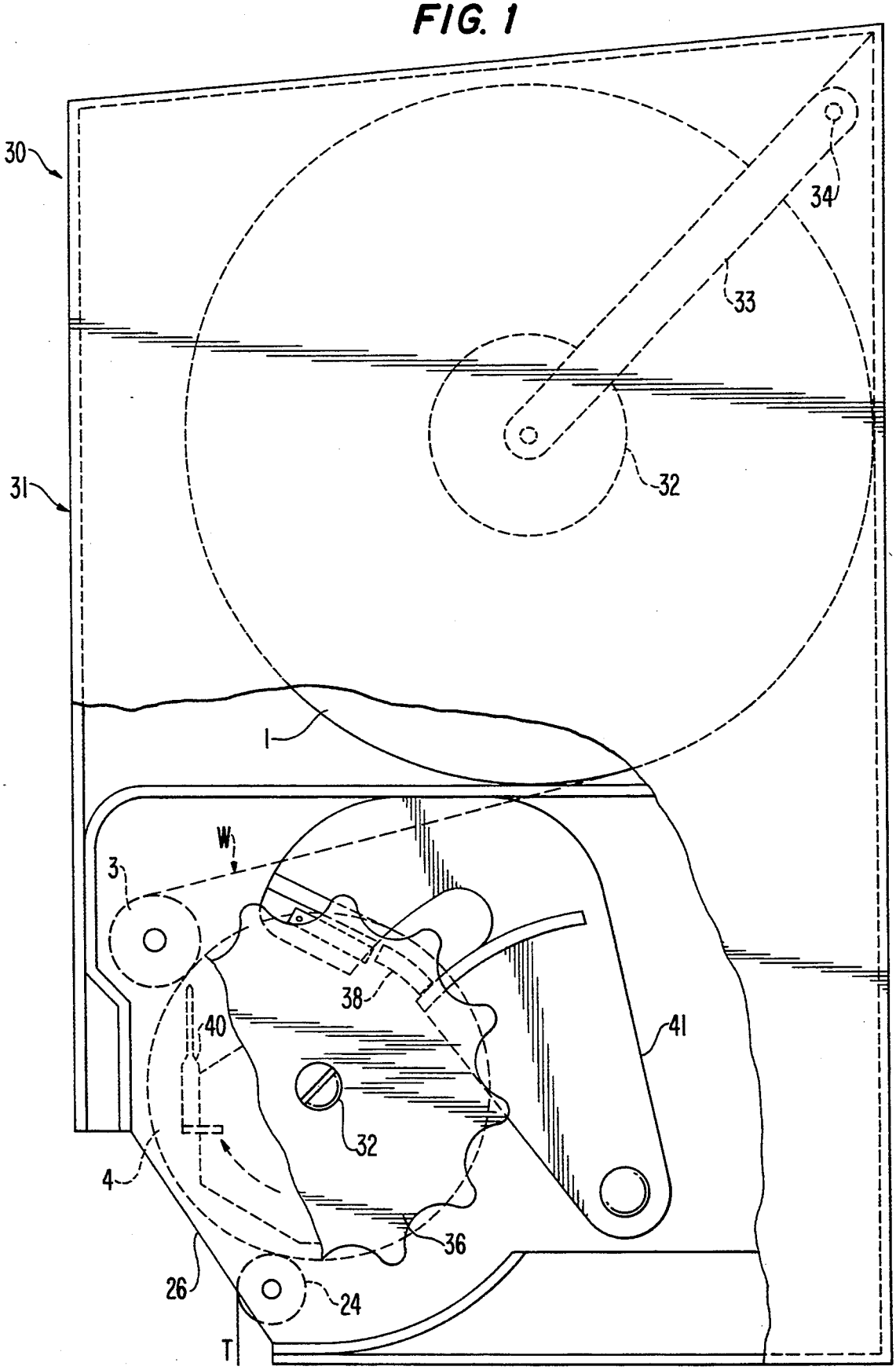
FIG. 1 is a side elevational view, with portions in section, of a rolled web dispenser.
Figure 2:
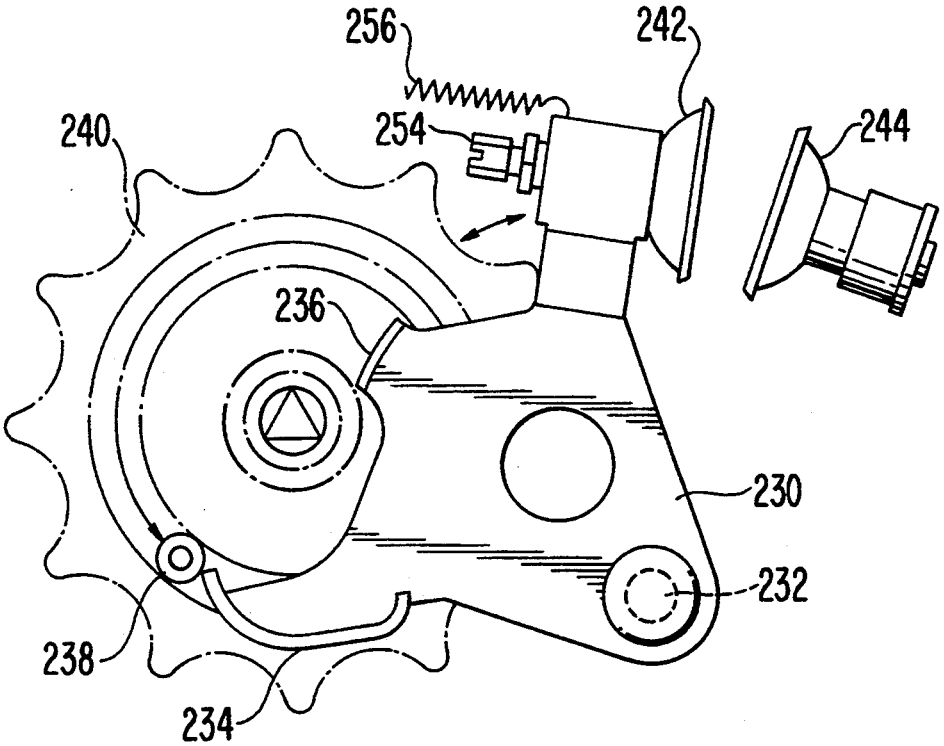
FIG. 2 is an elevational view of the stop mechanism and associated elements used in a prior art dispenser, wherein the stop mechanism is in an unlatched position.
Figure 3:
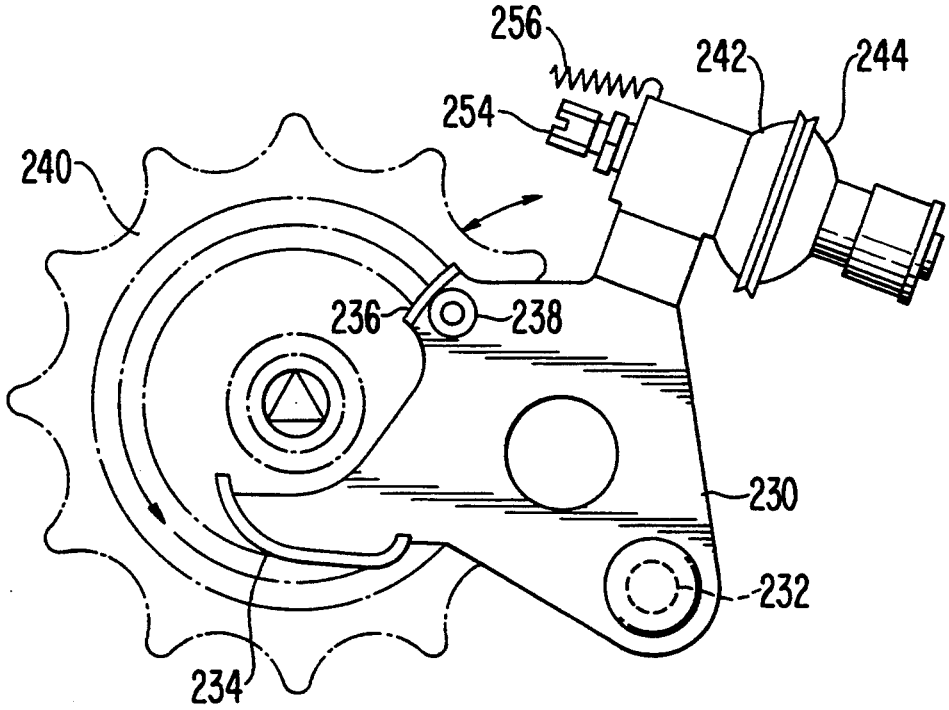
FIG. 3 is an elevational view of the stop mechanism and associated elements used in a prior art dispenser, wherein the stop mechanism is in a latched position.
Figure 4:
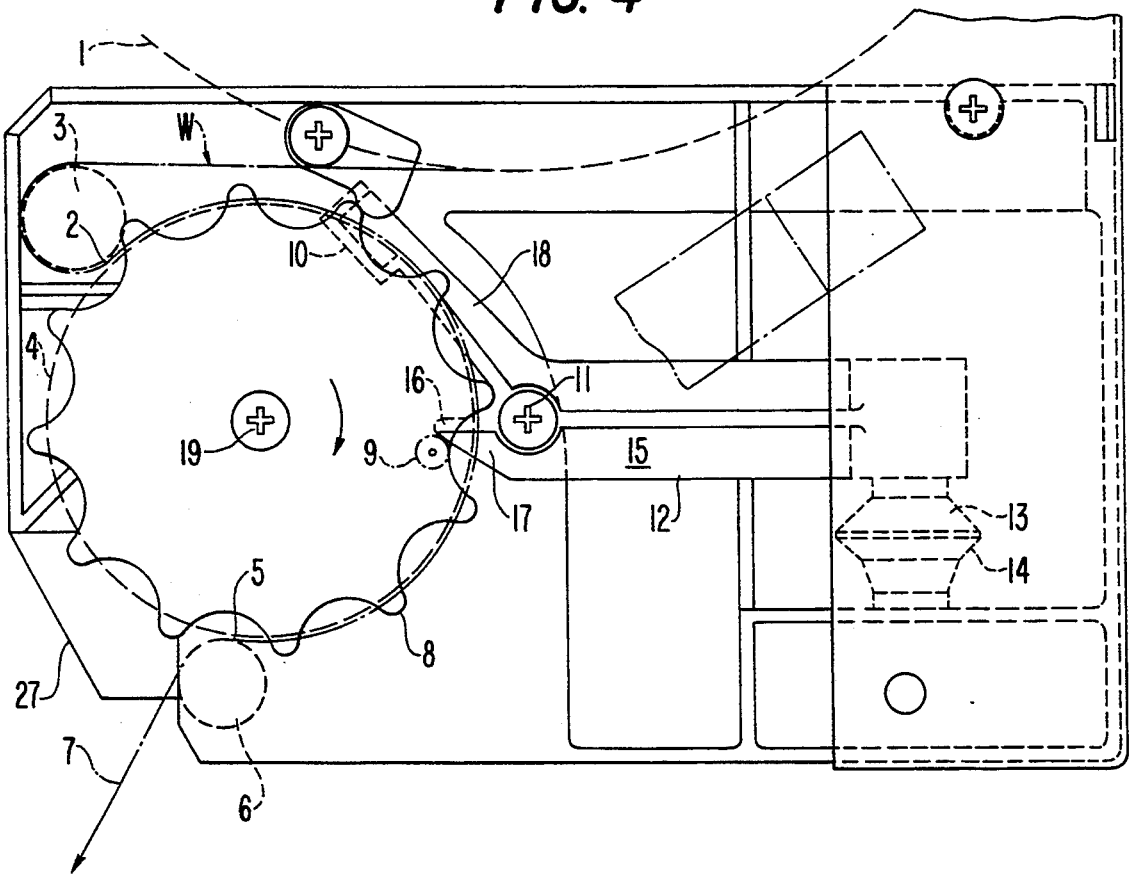
FIG. 4 is a side elevational view of a rolled web dispenser in accordance with Applicant's invention displaying the stop mechanism associated with the feed roller and feed wheel.

FIG. 4 illustrates one embodiment of the one-revolution stop mechanism of Applicant's invention. Web W withdrawn from roll 1 is threaded counterclockwise around a pinchroller 3 through a nip 2. The web then passes clockwise around the rearside of feed roller 4 to pass counterclockwise over exit pinchroller 6 through a nip 5. The web then exits through opening 27 in cabinet 31 to be accessible to intending users of the paper toweling material coming from roll 1. Preferably a tab length 7 of the toweling web W of about 3 inches will extend outside the dispenser beyond opening 27 to be available for grasping by the intending users of the web material. This preferred length 7 of web material is automatically fed from the dispenser 30 in conjunction with the operation of the stop mechanism in accordance with Applicant's invention.

The feed roller 4 has an internal knife as known in the art which is mounted laterally offset from the rotational axis of feed roller 4. The knife is supported within the feed roller to project through an opening (not shown) in the feed roller periphery to essentially sever the web material when it passes over the feed roller surface as the feed roller makes a single revolution. The web material is thus perforated to leave only three uncut $\frac{1}{4}$ inch long tabs connecting successive sheets in the web. This transverse perforating of the web material in cabinet 31 defines individual sheets which are of a length equal to the feed roller circumference so that the web W is formed with a row of perforations between one sheet and the next succeeding sheet.

Feed roller 4 is rotatably mounted by a shaft which extends through a bearing which is carried by the sidewall of cabinet 31 at pivot point 19. The shaft extends outwardly beyond the bearing and has a feed wheel 8 fixedly secured to its outer end. The shaft and feed wheel 8 are driven by the towel web being pulled from the dispenser. The feed wheel 8 has a camming lug 9 which cooperates with a stop lever 15.

Stop lever 15 is pivotally mounted at point 11 on one of the side plates of dispenser cabinet 31 and is provided with a recipient arm 12, a long actuating arm 18 and a short actuating arm 17. Vacuum cup 13 is attached to the end of arm 12 which cooperates with vacuum cup 14 as shall be discussed below.

Figure 5:
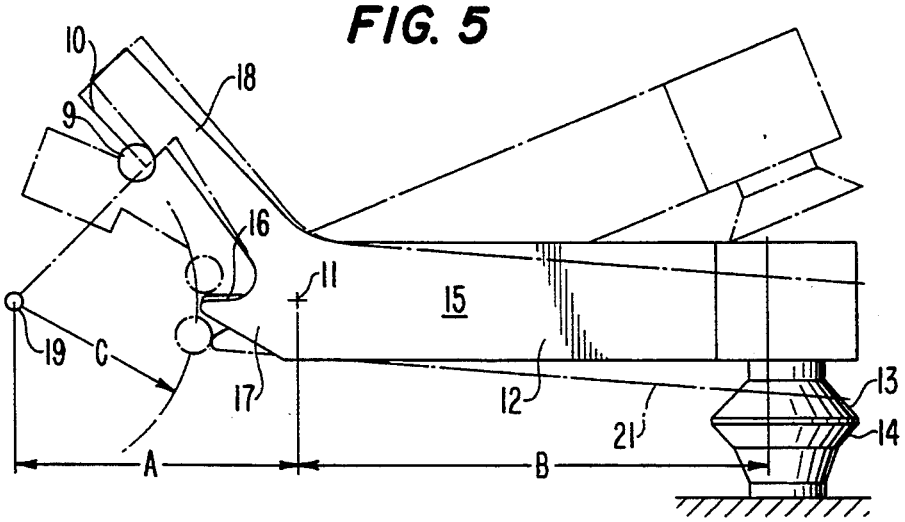
FIG. 5 is a side view of a stop lever and vacuum cup timer in accordance with Applicant's invention.

As web W is being pulled from the dispenser by a user, actuating lug 9 rotates with feed wheel 8 and engages surface 10 of stop lever 15 as shown in FIG. 5, thus causing a movement of stop lever 15 about pivot point 11. As stop lever 15 pivots, vacuum cup 13 is bought into vacuum engagement with vacuum cup 14 to expel air trapped between the vacuum cups. This is the compression stroke of stop level 15. The air expelled from between vacuum cups 13 and 14 causes a vacuum to be created between the cups. The vacuum causes stop lever 15 to be held in a latched position as shown in FIG. 5. During this initial period, feed wheel 8 continues to rotate until lug 9 engages surface 16 of short arm 17. When this occurs, feed roller 4 and the freedom of movement of the web material are abruptly stopped. Thus, the pull applied by the intending user on the web separates the web along the row of perforations for the user to receive an individual sheet.

Thus in summary, when web W is pulled through the dispenser, feed roller 4 is caused to rotate which in turn causes feed wheel 8 to rotate in a corresponding manner. After feed wheel 8 has rotated a predetermined distance, lug 9 engages and slides across surface 10 of arm 18, thereby causing arm 18 to pivot upwardly about pivot point 11. Accordingly arm 12 causes vacuum cup 13 to engage vacuum cup 14. The relatively high mechanical advantage of long arm 18 pivoting stop lever 15 about point 11 causes cup 13 to firmly engage fixed cup 14, thus expelling air trapped in cavity 20 (See FIG. 6) formed by the vacuum cups. A seal 21 is formed by the lips of the mating vacuum cups, thus holding arm 12 down by the pneumatic pressure created by the vacuum. Arm 17 is therefore held in a latched upward position so that lug 9 engages surface 16 to interrupt the rotation of feed wheel 8.

Figure 6:
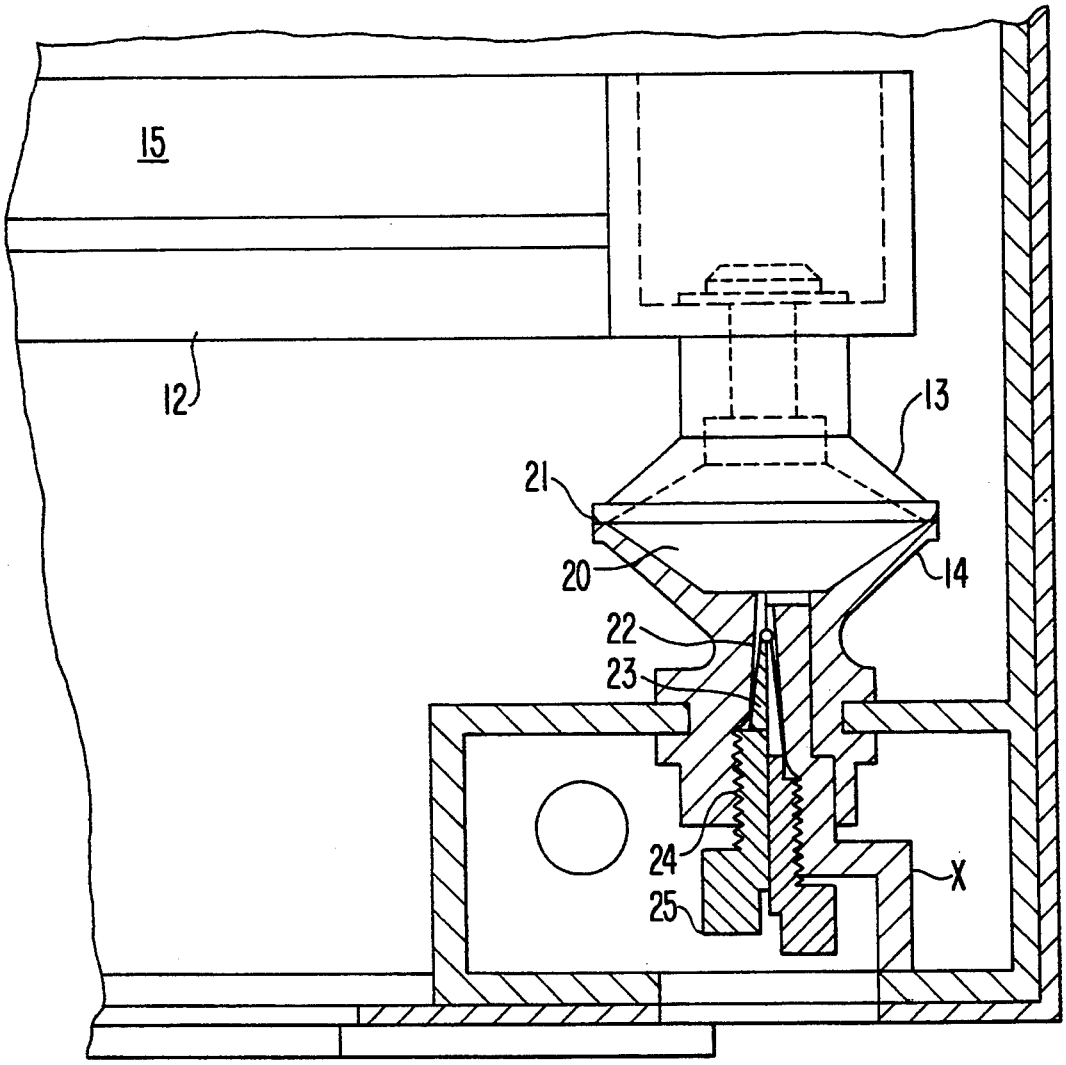
FIG. 6 is a side elevational view of a vacuum cup timer in accordance with Applicant's invention.

The low force required to create the relatively high mechanical advantage provided by stop lever 15 for setting vacuum cups 13 and 14 is abruptly reversed by the high pneumatic force holding arm 12 in position 21 as shown in FIG. 6 and the relatively low mechanical leverage force exerted by arm 17 to resist the rotational force of lug 9 as lug 9 engages surface 16 of arm 17. When vacuum cups 13 and 14 are compressed, they perform a most critical function.

Both the pneumatic and elastic characteristics of Applicant's stop mechanism serves to absorb the energy generated when the mechanism is cycled and abruptly stopped. As feed wheel 8 rotates and lug 9 strikes surface 16 of short arm 17, stop lever 15 tries to rotate around pivot 11 and separate vacuum cups 13 and 14. However, due to the position stop lever 15 has now taken, the forward rotation of the mechanism is arrested, energy is dissipated and the towel web separates along perforations.

Applicant has found that the relationship between dimensions A and B and radius C of stop lever 15, as illustrated in FIG. 5, can be optimized to achieve smooth and effortless operation of the stop mechanism. The relatively long length of arm 18 provides a significant mechanical advantage for sitting vacuum cups 13 and 14 in vacuum-gripping relation.

It has been found that dimension A should be at least one-half that of dimension B. Such a length permits a relatively small amount of camming force from lug 9 to be translated into a relatively large force at the end of arm 15 for setting vacuum cups 13 and 14 in vacuum gripping relationship.

The mechanical advantage manifest by the construction of Applicant's stop lever is made evident by the greatly reduced force required of the user to pull a single towel from the dispenser. In addition, the smooth camming action of lug 9 along surface 10 results in the smooth operation of the stop mechanism which is apparent to the user.

As shown in FIG. 5, radius C is chosen such that surface 10 is in line with pivot point 11 while lug 9 is in engagement with surface 10 as illustrated in FIG. 5. This orientation of surface 10 with pivot point 11 creates an easy progression of force between surface 10 and lug 9 as lug 9 passes through its toggle point between surface 10, lug 9 and pivot point 19.

After a predetermined delay, it is necessary to provide a venting device to induce air back into the vacuum created when vacuum cups 13 and 14 were compressed so that chamber 20 can be reformed. The venting device can be on either the moving cup 13 or the fixed cup 14. Needle valve 25 shown in FIG. 6 serves this purpose. An orifice 22 is provided in vacuum cup 14 which cooperates with stem 23. Air can be metered into chamber 20 by moving stem 23 relative to orifice 22 and allowing the air to bleed past threads 24.

Figure 9:
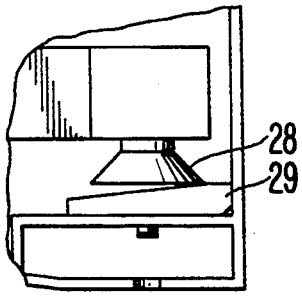
FIG. 9 is a side elevational view of another embodiment of the vacuum cup timer of Applicant's invention.

FIG. 9 illustrates another embodiment of the vacuum cup timer of Applicants invention. In this embodiment, flat plate 29 replaces vacuum cup 14.

FIGS. 10–14 illustrate another embodiment of lug 9. Lug **9*a* extends from the center portion of feed wheel 8 and has a shank portion 9*b*. Shank portion 9*b*** provides additional shock absorption characteristics and has been found by Applicant to lend considerable reliability to the stop mechanism.

Figure 7:
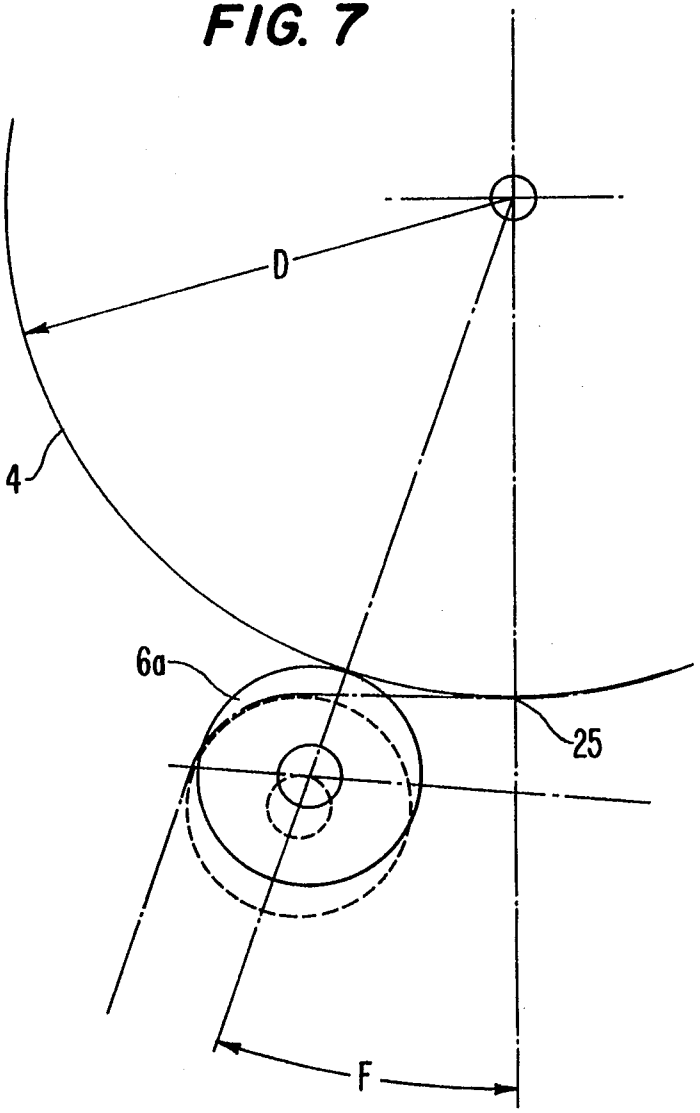
FIG. 7 is a side elevational view showing the operation of the exit pin roller in a prior art dispenser.
Figure 10:
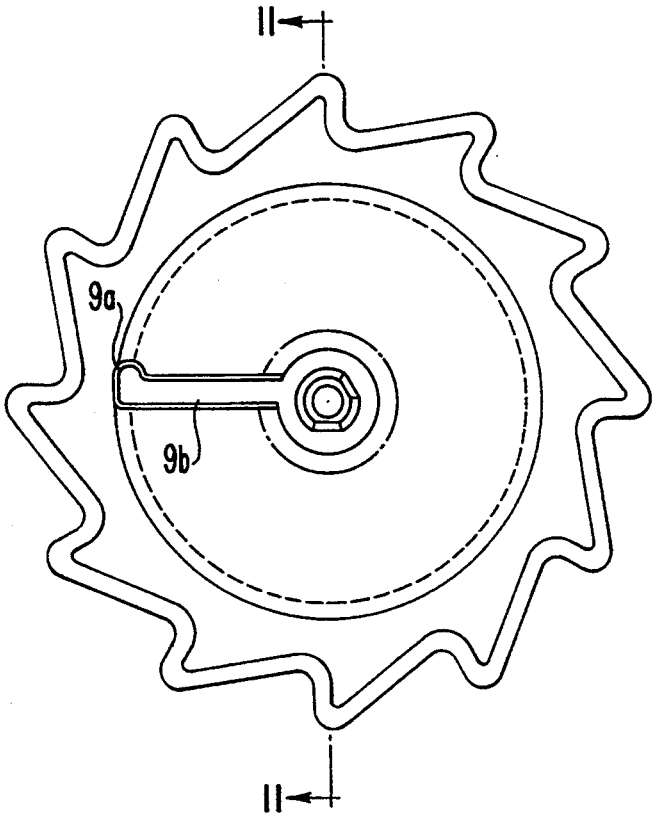
FIG. 10 is a front side elevational view of another embodiment of the camming lug which cooperates with the stop lever of Applicant's invention.
Figure 11:
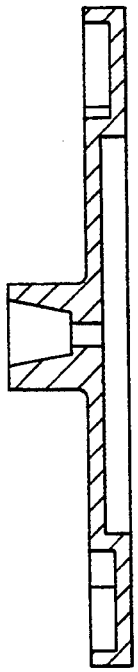
FIG. 11 is a cross-sectional view taken along line 11—11 in FIG. 10.
Figure 12:
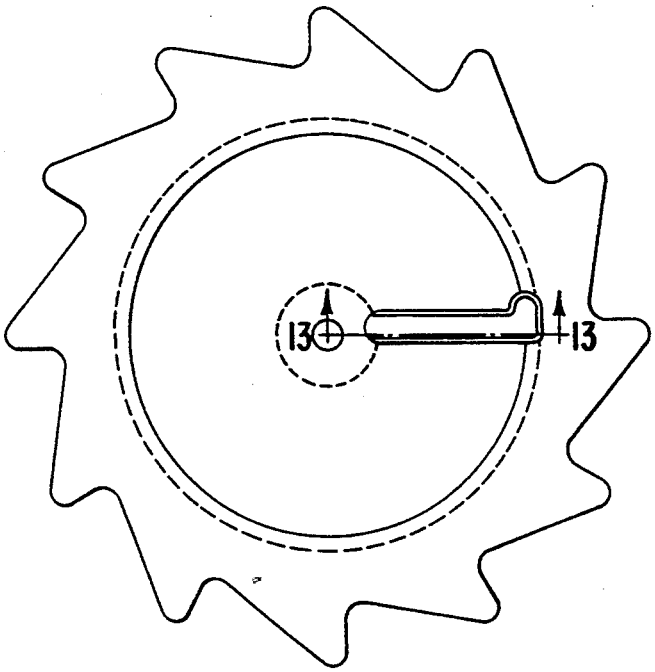
FIG. 12 is a rear side elevation view of the camming lug shown in FIG. 10.
Figure 13:
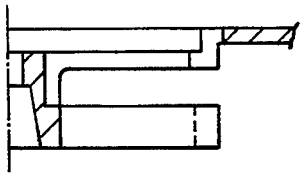
FIG. 13 is a cross-sectional view taken along line 13—13 in FIG. 12.
Figure 14:
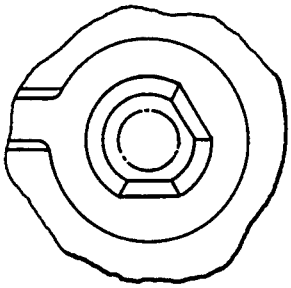
FIG. 14 is an enlarged elevational view of the center portion of FIG. 10.

In paper towel dispensers where the towel web is severed or perforated internally, a device must be provided to prevent the premature separating of individual towels from the following web as it uncoils from the supply roll of toweling. In prior art dispensers, spring biased exit pinch rollers were used as shown in FIG. 7. To be effective, a high degree of force is required to hold this type of pinch roller in contact with the feed roller, requiring greater force to cycle the mechanism. Strong, thus, harsh, paper toweling is therefore required.

If a lower spring force is used to lower the energy requirements for cycling the mechanism in order to dispense a soft plush towel, the lower pinch roller would move out of contact with the feed roller when the towel web is pulled out of the dispenser shown in FIG. 7. In this case the towel will separate at point 25, or further back in the mechanism, thus making the dispenser appear to be empty.

Figure 8:
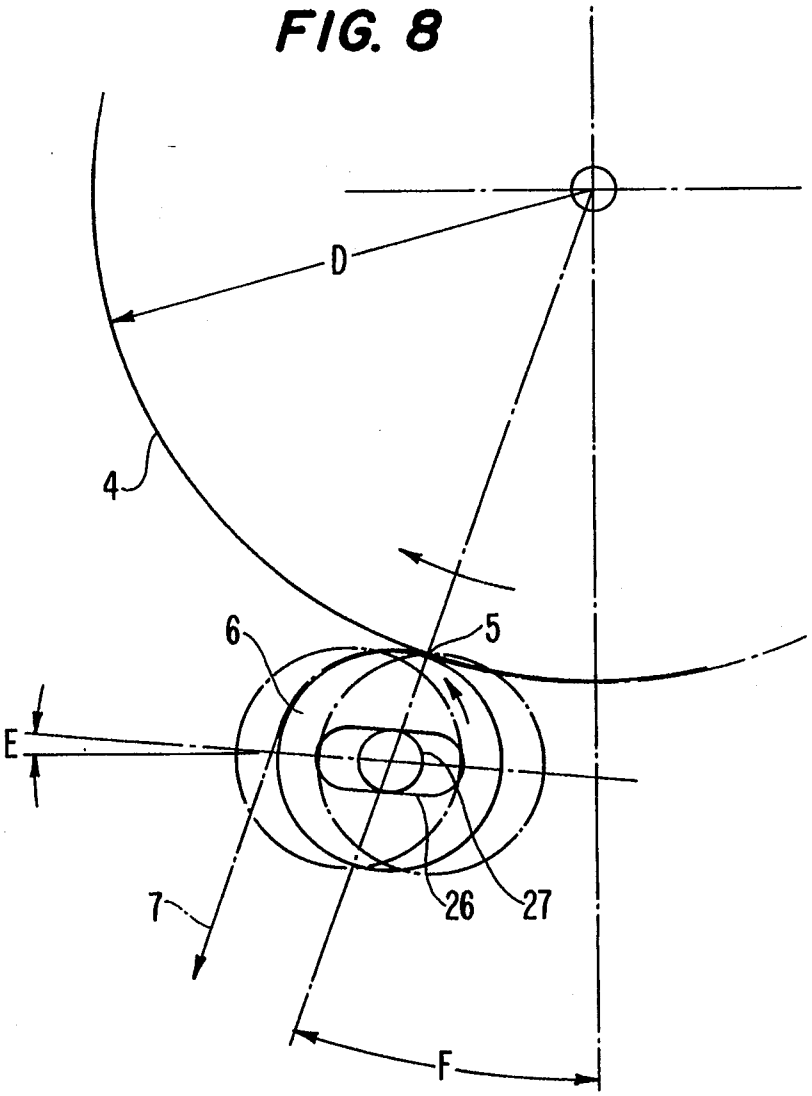
FIG. 8 is a side elevational view showing the operation of an exit pin roller in accordance with Applicant's invention.

Applicant's dispenser overcomes this problem by the use of a lower pinch roller 6 which is mounted in a slot 26 as shown in FIG. 8. Slot 26 is in angular relationship E, as illustrated in FIG. 8, with the feed roller so as to move away from nip 5 when the mechanism is cycled and into a biting relationship when the web is pulled. This assures that the towel will separate outside the dispenser past point 5. In the above configuration, shaft 27 is allowed to float so that the portion of web 7 exerting the most pressure on roller 6 will be held the firmest at point 5.

It should be obvious from the above-discussed apparatus embodiment that numerous other variations and modifications of the apparatus of this invention are possible, and such will readily occur to those skilled in the art. Accordingly the scope of this invention is not to be limited to the embodiment disclosed, but is to include any such embodiments as may be encompassed within the scope of the claims appended hereto.

We claim:

1. A dispenser for rolled web material, said dispenser comprising:

a dispenser cabinet having means in said cabinet for mounting a roll of web material;

a feed roller rotatably mounted on a shaft in said cabinet to guide said web from the roll to the exterior of said cabinet, so that said web may be grasped by a user and pulled out of said dispenser;

camming pin means rotatable with said feed roller and spaced radially from the feed roller axis for providing a camming action;

a cutter mechanism associated with said feed roller to transversely perforate said web as it passes over said feed roller;

a stop mechanism for stopping the operation of said feed roller and said cutter mechanism to arrest the movement of said web for a predetermined period of time after a predetermined length of said web has been withdrawn from said dispenser, said stop mechanism including lever means mounted to pivot in a plane normal to the axis of said feed roller for activating said stop mechanism, said lever means having a first engagement arm, a second engagement arm and an actuating arm, a first end of said arms terminating at the pivot point of said lever means, said first engagement arm being adapted to engage said camming pin means to raise said first engagement arm to a high level and said actuating arm to a low level as said feed roller rotates, said second engagement arm being adapted to engage said camming pin means after said first engagement arm has been raised, said second engagement arm holding said camming pin and preventing said feed roller from rotating for a predetermined period of time, wherein a feed wheel is fixedly secured to said shaft means and said camming pin means is carried by said feed wheel, said camming pin means is formed of a cam portion and a shank portion, said shank portion extending along a side of said feed wheel to a center portion of said feed wheel, said shank portion being attached to said feed wheel at said center position.

2. A dispenser according to claim 1 wherein said cutter mechanism includes a cutting blade mounted within said feed roller.

3. A dispenser according to claim 1 wherein said first engagement arm has a earn follower surface which engages said camming pin means, said surface being aligned with the pivot point of said lever means.

4. A dispenser according to claim 1 wherein said camming pin means extends from the peripheral side edge of said feed wheel.

5. A dispenser according to claim 1 wherein said cam portion being located adjacent the peripheral side edge of said feed wheel.

6. A dispenser for rolled web material, said dispenser comprising:

a dispenser cabinet for at least one roll of web material;

a feed roller rotatably mounted on a shaft in said cabinet to guide said web from the roll to the exterior of said cabinet, so that said web may be grasped by a user and pulled out of said dispenser;

a camming lug rotatable with said feed roller and spaced radially from the feed roller axis;

a cutter mechanism associated with said feed roller to transversely perforate said web as it passes over said feed roller; and a stop mechanism for stopping the operation of said feed roller and said cutter mechanism to thus arrest the movement of said web for a predetermined period of time after a predetermined length of said web has been withdrawn from said dispenser, said stop mechanism including a stop lever pivotably mounted at a pivot point adjacent said feed roller and in a plane normal to the axis of said feed roller, said stop lever having a long actuating arm, a short actuating arm and a recipient arm, all of said arms extending from said pivot point, said long actuating arm having a long arm camming lug engagement surface and said short arm having a short arm camming lug engagement surface, said recipient arm including a vacuum cup attached at one end for forming a vacuum to stop movement of said stop lever, the distance between the feed roller axis and said pivot point being at least one-half the distance from said pivot point to said vacuum cup and said long arm camming lug engagement surface being in line with said pivot point when said camming lug contacts said long arm camming lug engagement surface, and when said camming lug engages said short arm camming lug engagement surface said top lever pivots and releases said feed roller upon release of said vacuum cup.

7. The dispenser according to claim 6 wherein said stop lever pivots without the aid of spring bias.

8. The dispenser according to claim 6 further comprising a lower pinch roller mounted in said dispenser cabinet within a slot fixed at an angular relationship to a radius of said feed roller, said lower pinch roller moving out of biting contact with said feed roller when said cutter mechanism is being cycled and into biting contact with said feed roller, without the aid of spring bias, when said web material is being pulled and separated into sheets.

9. The dispenser according to claim 6 wherein said predetermined period is determined by a timer.

10. The dispenser according to claim 9 wherein said timer is a valve associated with said vacuum cup such that air is allowed to enter the vacuum cup and destroy the vacuum created.

11. The dispenser according to claim 6 wherein said vacuum cup contacts and forms said vacuum with another stationary vacuum cup.

* * * * *